US006843477B2

(12) United States Patent
Simmons, Jr.

(10) Patent No.: US 6,843,477 B2
(45) Date of Patent: Jan. 18, 2005

(54) ROCK, PAPER, SCISSORS CARD GAME AND METHODS OF PLAY

(76) Inventor: Robert E. Simmons, Jr., P.O. Box 1382, 22 Grove St., Wolfeboro, NH (US) 03894

( * ) Notice: Subject to any disclaimer, the term of this patent is extended or adjusted under 35 U.S.C. 154(b) by 0 days.

(21) Appl. No.: 10/633,270

(22) Filed: Aug. 1, 2003

(65) Prior Publication Data

US 2004/0090007 A1 May 13, 2004

Related U.S. Application Data

(60) Provisional application No. 60/416,599, filed on Oct. 7, 2002.

(51) Int. Cl.[7] ..... A63F 1/00

(52) U.S. Cl. ..... 273/292; 273/308; D21/376; D21/383; D21/384

(58) Field of Search ..... 273/292, 302–306, 273/308; D21/376, 378–384

(56) References Cited

U.S. PATENT DOCUMENTS 4,327,919 A * 5/1982 Vennor ..... 273/236
5,863,040 A * 1/1999 Van Gass ..... 273/292
D457,571 S * 5/2002 Edwards, Jr. ..... D21/376
6,598,880 B2 * 7/2003 Addabbo ..... 273/306

FOREIGN PATENT DOCUMENTS

GB 2286131 * 8/1995
WO WO 0123050 * 4/2001

* cited by examiner

*Primary Examiner*—Benjamin Layno
(74) *Attorney, Agent, or Firm*—Bourque & Associates, P.A.

(57) ABSTRACT

A deck of rock, paper, scissors playing cards and methods of play therewith are disclosed. The deck has fifty-two cards including four wild cards identified as little sister cards and little brother cards, and forty-eight cards including fourteen paper cards, fourteen rock cards, fourteen scissor cards, two crumpled paper cards, two broken rock cards, and two broken scissors cards. Each of the cards has a point value.

The associated method includes playing the cards against each other wherein the cards have a hierarchy based on the pictorial. The hierarchy determines the winner of each game. The cards having point values for determining the points awarded for each card.

20 Claims, 3 Drawing Sheets

ROCK, PAPER, SCISSORS CARD GAME AND METHODS OF PLAY

CROSS-REFERENCE TO RELATED APPLICATIONS

This application claims priority from U.S. Provisional Patent Application No. 60/416,599, entitled "The Original Rock Paper Scissors Card Game," which was filed on Oct. 7, 2002.

TECHNICAL FIELD OF THE INVENTION

The present invention relates to the field of playing cards and more particularly, relates to rock, paper, scissors playing cards and methods of play therewith.

DESCRIPTION OF THE RELATED ART

Playing cards have been around for a very long time. English playing cards are known and used all over the world. In England, Whist, Cribbage, Rummy, and Nap are popular card games. In other European countries, Skat, Jass, Mus, Scopa, and Tarock are played, using cards of totally different face-designs many of them with roots far older than English cards.

A standard deck of cards in the United States has three groups of cards including numbered cards, face cards (i.e., king, queen, and jack cards), and ace cards. Further, the standard deck of cards has four suits that include hearts, spades, diamonds, and clubs. Each of the numbered cards, face cards, and ace cards is marked with one of the suits (e.g., 7 of hearts). For example, there are four eights in a typical deck of cards. Each of the cards numbered with the number eight has a different suit thereon (i.e., one eight has a heart thereon, one eight has a spade thereon, one eight has a diamond thereon, and one eight has a club thereon). There are numerous card games played with these standard playing cards.

There are variations to the standard card games previously explained. For example, UNO is a card game that does not use the cards previously described.

The Applicant has developed a new deck of playing cards with colorful and playful pictures of rocks, papers, scissors, broken rocks, crumpled papers, broken scissors, little sister, and little brother thereon and methods of play therewith and methods of play therewith.

SUMMARY OF THE INVENTION

The present invention is a novel rock, paper, scissors deck of playing cards and methods of play therewith. The deck of cards has colorful, playful pictures of rocks, papers, scissors, broken rocks, crumpled papers, broken scissors, little sisters and little brothers thereon. The deck of cards and methods of play are fun and educational requiring recognition of visual characters, addition, subtraction, and reasoning skills. The methods of play include the Get All The Cards, Most Points, Win Game!, and Reach The Goal games.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 5:
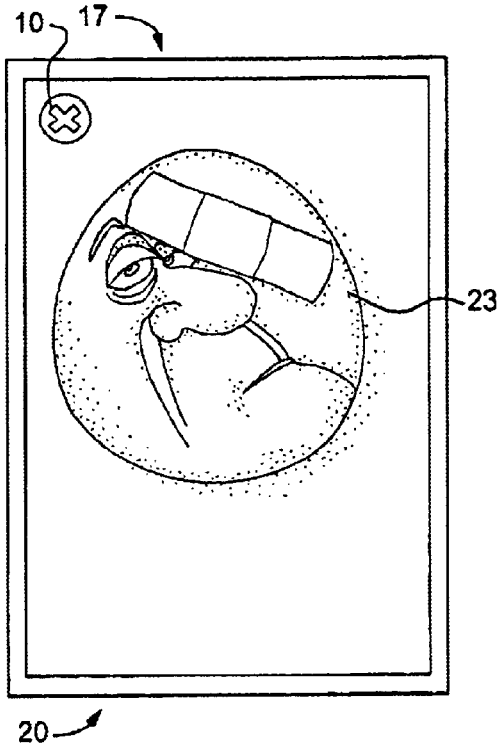
FIG. 5 illustrates a "broken rock" card according to the present invention.
Figure 6:
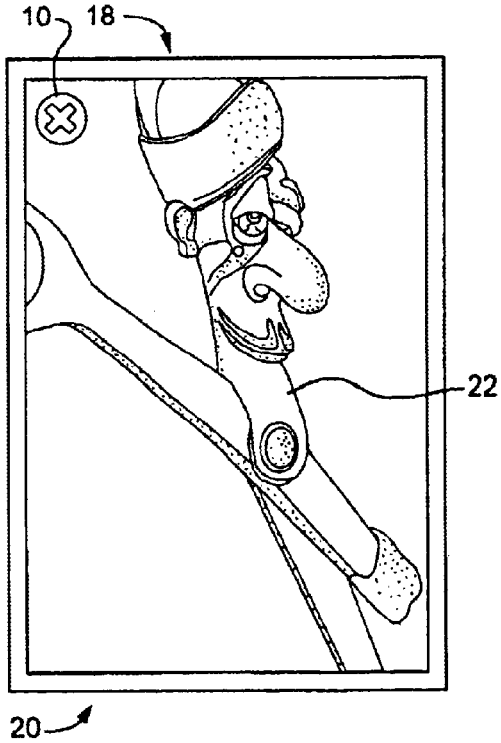
FIG. 6 illustrates a "broken scissor" card according to the present invention.
Figure 7:
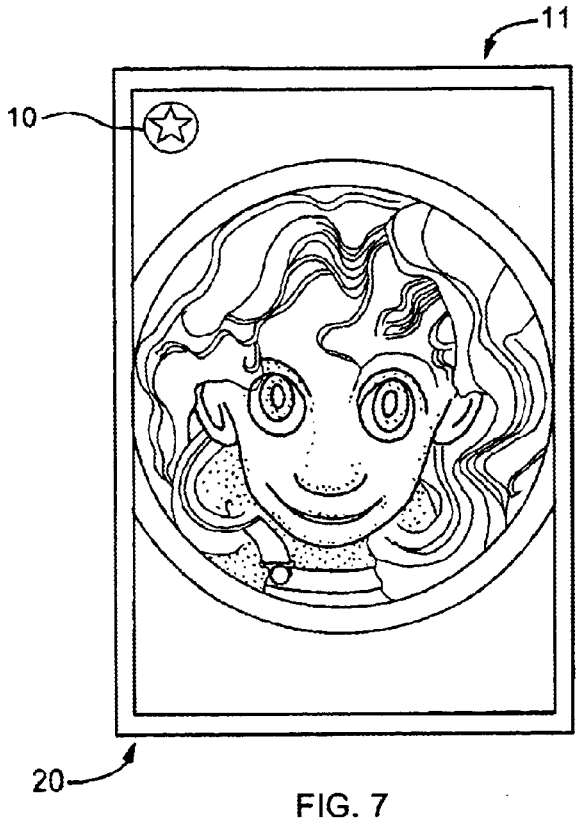
FIG. 7 illustrates a "little sister" card according to the present invention.
Figure 8:
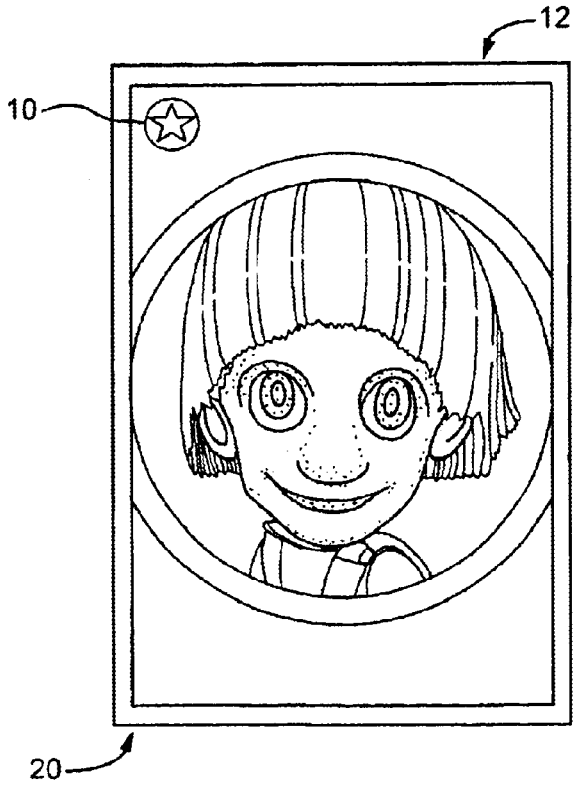
FIG. 8 illustrates a "little brother" card according to the present invention.

The present invention has fifty-two cards 20 in a deck. Each of the cards 20 has a point value 10 as shown in FIGS. 1–8. The deck of cards 20 has four wild cards. The four wild cards include two little sister cards 11 and two little brother cards 12 (hereinafter collectively referred to as "wild cards") as shown in FIGS. 7 and 8, respectively. The remaining forty-eight cards are broken down into paper cards 13 (FIG. 1), rock cards 14 (FIG. 2), scissor cards 15 (FIG. 3), crumpled paper cards 16 (FIG. 4), broken rock cards 17 (FIG. 5), and broken scissors cards 18 (FIG. 6). Specifically, there are fourteen of the paper cards 13, fourteen of the rock cards 14, fourteen of the scissor cards 15, two of the crumpled paper cards 16, two of the broken rock cards 17, and two of the broken scissors cards 18 in the deck.

Figure 1:
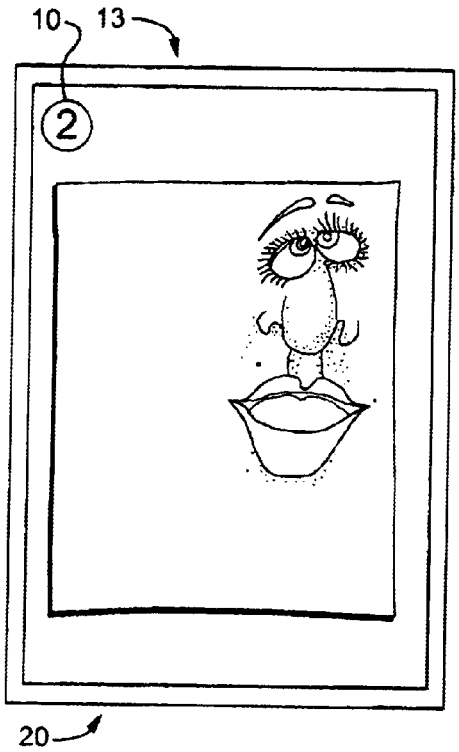
FIG. 1 illustrates a "paper" card according to the present invention.
Figure 2:
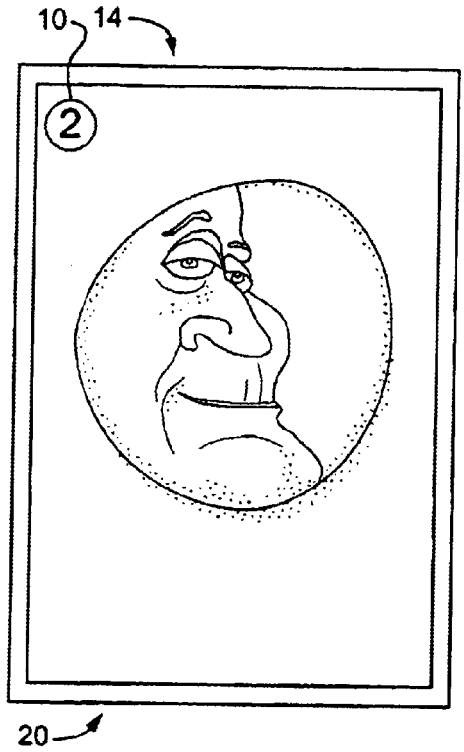
FIG. 2 illustrates a "rock" card according to the present invention.
Figure 3:
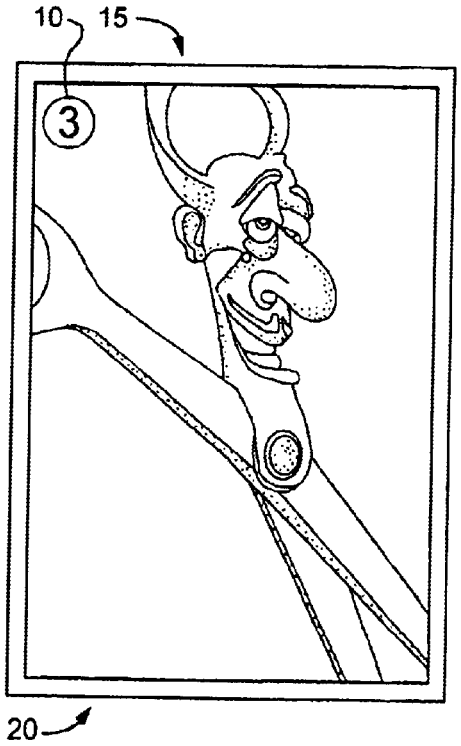
FIG. 3 illustrates a "scissor" card according to the present invention.
Figure 4:
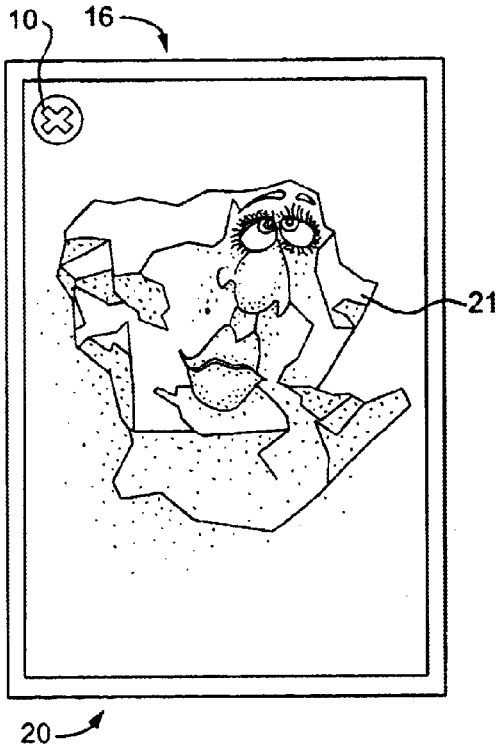
FIG. 4 illustrates a "crumpled paper" card according to the present invention.

The crumpled paper cards 16 are distinguished from the paper cards 13 by showing a crumpled piece of paper 21 or some other indication of damage/injury as shown in FIG. 4. The broken rock cards 17 are distinguished from the rock cards 14 by a bandage 23 on the rock or some other indication of damage/injury as shown in FIG. 5. The broken scissor cards 18 are distinguishable from the scissors cards 15 by a bandage 22 on the scissor or some other indication of damage/injury as shown in FIG. 6.

The point value 10 has a value or symbol therein. The value can be any number, which represents the point value for that particular card. In the preferred embodiment, the point value 10 of the paper cards 13, the rock cards 14, and the scissor cards 15 is any number from 1 to 5, wherein the number represents the points awarded for that card 20 (e.g., 1 is worth 1 point, 2 is worth 2 points, etc.). The "X" symbols in the point values 10 on the crumpled paper cards 16, the broken rock cards 17, and the broken scissors cards 18 (hereinafter collectively referred to as "damaged cards") are worth zero points. The star symbols in the point values 10 on the little sister cards 11 and the little brother cards 12 are worth 10 points.

In an alternative embodiment, the paper cards 13, the rock cards 14, the scissor cards 15, the crumpled paper cards 16, the broken rock cards 17, and the broken scissors cards 18 have historical and geographical landmarks, historical documents, and a variety of cutting devices thereon. For example, the paper cards 13 may have a photograph, drawing, or visual representation of the Declaration of Independence, Magna Carta, Louisiana Purchase, United States Constitution, Oath of Office for President, Gettysburg Address, Pledge of Allegiance, and National Anthem. The scissors cards 14 may have a photograph, drawing, or visual representation of hair cutters, tin snips, scissor lifts, grooming scissor, medical scissors, toenail scissors, industrial scissors, animal shears, and pruning shears. The rock cards 14 may have a photograph, drawing, or visual representation of Mount Everest, Rock of Gibraltar, Rock Mountains, Grand Canyon, Mount Fuji, Mount Saint Helens, Mount Washington, Washington Monument, Lincoln Monument, Great Wall of China, Great Dams, Great Museums, moon, meteors, and planets. Obviously, in addition, the crumpled paper cards 16, the broken rock cards 17, and the broken scissors cards 18 will have evidence of an injury or be damaged as explained above.

In an alternative embodiment, the point values 10 of the paper cards 13 and the rock cards 14, are determined based on the prominence of the historical and geographical landmarks, and historical documents, and the point values 10 of the scissor cards 15 are based on the type of the cutting devices, displayed on the card 20. For example, Mount Everest may be given a higher point value than Mount Washington because Mount Everest is known the world over whereas Mount Washington is known predominantly in the United States.

The present invention includes these unique cards 20 and methods of play that relate to the cards 20. The general hierarchy rules of the game are explained as follows. The paper card 13 wins over the rock card 14, but the paper card 13 loses to the scissor card 15. The rock card 14 wins over the scissor card 15, but the rock card 14 loses to the paper card 13. The scissor card 15 wins over the paper card 13, but the scissor card 15 loses to the rock card 14.

Further to the general hierarchy rules, the wild cards 11, 12 win over all of the other cards 20. One wild card 11, 12 does not win over another wild card 11, 12. For example, if the little sister card 11 is drawn against the little brother card 12, these cards tie.

Further to the general hierarchy rules, the damaged cards 16, 17, 18 lose to all of the other cards 20. One damaged card does not win over another damaged card. For example, if the crumpled paper card 16 is drawn against the broken rock card 17, these cards tie. Further, when there is no winner and new flip is required, the damaged cards are automatically out of and do not flip again until a winner is declared for those cards 20. There is one exception to this automatic out rule and that is if all players flip a damaged card. If that is the case, the players having the damaged cards flip again to determine a winner.

The following examples illustrate the cards 20 and outcome of a game for three players according to the present invention.

Example one: 1 rock card, 1 paper card, 1 scissor card results in no winner and all of the players play again. Example two: 2 rocks cards, 1 paper card results in a win for the player having the paper card. Example three: 2 paper cards, 1 rock card results in a tie between the players having the paper cards and a playoff is required for game one and two explained below. Example four: 1 rock card, 1 damaged rock card, 1 little sister card results in a win for the player having the little sister card. Example five: 1 broken rock card, 1 broken scissor card, 1 paper card results in a win by the player having the paper card. Example six: 1 broken rock card, 2 crumpled paper cards results in no winner and all of the players play again (exception to the automatic rule).

The following examples illustrate the cards 20 and outcome of a game according to the present invention.

Example seven: four player—2 rock cards, 2 paper cards results in a tie between the players having the paper cards and a playoff is required for game one and two explained below. Example eight: four players—2 rock cards, 1 paper card, 1 scissor card results in no winner and all of the players play again. Example nine: six players—1 rock card, 1 paper card, 1 scissor card, 2 crumpled paper cards, 1 broken rock card results in the players having the rock card, paper card, and the scissor card replaying their cards 20.

Game One: Win All the Cards

The Win All The Cards embodiment is played with two to four players. If three players are playing, one of the wild cards 11, 12 is removed from the deck of cards 20. All of the cards 20 in the deck are shuffled with the picture sides down and evenly distributed between, or dealt out to, each player with the picture sides down. Each player will place the cards 20 in a stack in front of him or her with the picture sides down. All players will simultaneously flip one of their cards 20, so that the picture on the card 20 is showing or facing upward. In an alternative embodiment, the players recited "rock, paper, scissors, go" and then simultaneously flip one of their cards 20, so that the picture on the card 20 is showing or facing upward.

The cards 20 (i.e., little sister cards 11, little brother cards 12, paper cards 13, rock cards 14, scissor cards 15, crumpled paper cards 16, broken rock cards 17, and broken scissors cards 18) are compared according to the previously described general hierarchy rules to determine a winner of the hand. The winner takes all of the cards 20 dealt for that hand.

If no one player wins and there can be no playoff for a win, all of the players simultaneously flip another card 20. If two or more players tie for the win, a playoff between the winners is played. The playoff requires each of the winners to place two cards 20 with the picture sides facing down in front of them on top of their tied cards 20. In an alternative playoff embodiment, each of the winners places three cards 20 with the picture sides facing down on top of the tied cards in front of them. Thereafter, each of the tied players flips another card 20 face up and on top of these picture side down cards 20 to decide a winner. The player with the winning card 20 takes the cards 20 placed picture side down, the cards 20 from the previous flip, and the cards 20 from the present flip. If there is no winner, another playoff is played, and the player with the winning card 20 takes the cards 20 placed picture side down, the cards 20 from the two previous flips, and the cards from the present flip. This playoff, tie breaking process, or push continues until there is a sole winner. The winner of the playoff, tie breaker, or push may use the cards 20 with the picture side facing down in the cards 20 won pile. If a player runs out of cards 20 and cannot continue with the playoff, tie breaker, or push, the player is out of the game. Once a player uses up his or her dealt cards 20, the player may shuffle the cards 20 he or she won and continue to play. Once a player is out of cards 20, he or she is out of the game. Once one of the players wins all of the cards 20, the game is over and that player wins the game.

Game Two: Most Points, Win Game!

The Most Points, Win Game embodiment is played with two to four players. If three players are playing, one of the wild cards 11, 12 is removed from the deck of cards 20. All of the cards 20 in the deck are shuffled with the picture sides down and evenly distributed between, or dealt out to, each player with the picture sides down. Each player will have a stack of cards 20 in front of him or her with the picture sides down. All players will simultaneously flip one of their cards 20, so that the picture on the card 20 is showing or facing upward. In an alternative embodiment, the players recited "rock, paper, scissors, go" and then simultaneously flip one of their cards 20, so that the picture on the card 20 is showing or facing upward.

The cards 20 (i.e., little sister cards 11, little brother cards 12, paper cards 13, rock cards 14, scissor cards 15, crumpled paper cards 16, broken rock cards 17, and broken scissors cards 18) are compared according to the previously described general hierarchy rules to determine a winner of the hand. The winner takes all of the cards 20 played for that hand and places them in a separate pile.

If no one player wins and there can be no playoff for a win, all of the players simultaneously flip another card 20. If two or more players tie for the win, a playoff between the winners is played. The playoff requires each player to place two cards with the picture sides facing down on top of the tied cards in front of them. In an alternative playoff embodiment, each of the winners places three cards 20 with the picture sides facing down on top of the tied cards in front of them. Thereafter, each of the tied players flips another card 20 face up and on top of these picture side down cards 20 to decide a winner. The player with the winning card 20 takes the cards 20 placed picture side down, the cards 20 from the previous flip, and the cards 20 from the present flip. If there is no winner, another playoff is played, and the player with the winning card 20 takes the cards 20 placed picture side down, the cards 20 from the two previous flips, and the cards from the present flip. This playoff, tie breaking process, or push continues until there is a sole winner. If a player runs out of cards 20 and cannot continue with the playoff, tie breaker, or push, the player is out of the game, and the game is over.

Once the first player runs out of cards 20, the game is over. Once the game is over, all of the players add their points in the point values 10 of the cards 20 that they won and subtract the points in the point values of the cards 20 originally dealt to them and still in their hand to obtain a grand total. The player having the highest grand total wins the game.

Game Three: Reach the Goal—Win!

The Reach The Goal—Win embodiment is played with two to seven players. A goal or score is set prior to distributing or dealing the cards 20 to the players. In the preferred embodiment, the goal is set at 100 points or more points. One of the players is designated a scorekeeper. The scorekeeper keeps track of the points each player wins. The points are taken from the point values 10 of the cards 20 that a player wins.

All of the cards 20 in the deck are shuffled with the picture sides down. For each round, seven cards are distributed or dealt out to each player with the picture sides down. At the beginning of the game, each player will have a stack of seven cards 20 with the picture sides down in front of him or her. All players will simultaneously flip one of their cards 20, so that the picture on the card 20 is showing or facing upward. In an alternative embodiment, the players recited "rock, paper, scissors, go" and then simultaneously flip one of their cards 20, so that the picture on the card 20 is showing or facing upward.

The cards 20 (i.e., little sister cards 11, little brother cards 12, paper cards 13, rock cards 14, scissor cards 15, crumpled paper cards 16, broken rock cards 17, and broken scissors cards 18) are compared according to the previously described general hierarchy rules to determine a winner of the hand. In this game, if two or more players tie for the winning hand, the winners flip another card 20. The winner of this hand takes the cards 20 from the previous flip and the cards 20 from the present flip. If there is still no winner, another card 20 is flipped until a winner is determined. The winner receives all of the cards 20 from the previous flips and the current flip. If any player runs out of cards 20, the player is out of that round. In the event that all of the players, at the same time, run out of cards 20 trying to determine a winner, the points from the point values 10 are evenly divided (and rounded up if necessary) between them.

The winner, or one of the winners, takes all of the cards 20 dealt for that hand and keeps them in front of them. When the last player is out of cards 20, therefore ending the hand, each player adds up their own points and a scorekeeper places this calculated value under the player's name. If needed, additional rounds of seven cards are distributed or dealt out to each player with the picture sides down until one player reaches the goal. Once a player reaches or exceeds the goal (e.g., 100 points), that player wins, and the game is over. If more than one player reaches or exceeds the goal at the same time, the highest total score wins. If there is still a tie at or over the goal score, the tied players play another hand to decide a winner. The highest score wins.

In an alternative embodiment to Game Three, the players play only the seven cards they are initially dealt. The player having the highest total score at the end of the seven cards wins the game and decides what they wish to throw.

In another alternative embodiment to the games previously described, the players are able to look at their cards 20 during the game.

Modifications and substitutions by one of ordinary skill in the art are considered to be within the scope of the present invention, which is not to be limited except by the following claims.

What is claimed is:

1. A method of playing a card game with a plurality of players using a deck of cards comprising fifty-two cards, wherein the fifty-two cards include three groups of cards, the three groups of the fifty-two cards comprising a plurality of wild cards having a little sister or little brother visual representation thereon, a plurality of scoring cards having a rock, paper, or scissors visual representation thereon, a plurality of non-scoring cards having a broken rock, crumpled paper, or broken scissors visual representation thereon, and wherein all of the three groups of cards have point values thereon indicating a value assigned to each card;

wherein a hierarchy of cards provides that the paper card wins over the rock card, the scissors card wins over the paper card, the rock card wins over the scissors card, the non-scoring cards lose to all other cards, any one of the non-scoring cards does not win over another of the non-scoring cards, the wild cards win over all other cards, and any one of the wild cards does not win over another of the wild cards;

wherein an object of the card game is to be a player that wins all of the cards in the deck, said method of playing comprising the acts of:

shuffling all of the cards in the deck with faces down;

evenly distributing the cards with the faces down between the plurality of players;

having each of the plurality of players stack the distributed cards in a stack in front of them;

having each player simultaneously flip one card so that the face of the card is up;

comparing the flipped cards according to the hierarchy of cards;

determining a winner based on the flipped cards; and having the winner take all of the flipped cards.

2. The method of playing a card game with a plurality of players using a deck of cards according to claim 1, further comprising the acts of:

conducting a playoff if the act of determining the winner results in a tie between two or more players, the playoff comprising the acts of:

having the two or more players that tied place two cards with the face sides down on top of their previous flipped card;

having the two or more players flip another card face side up and on top of the two cards placed face side down;

determining the winner from the just flipped cards; and having the winner take all of the playoff cards, the tied cards that forced the playoff, and any card that lost in the tie that forced the playoff.

3. The method of playing a card game with a plurality of players using a deck of cards according to claim 1, further comprising the acts of:

conducting a second flip if the act of determining the winner results in no one player winning, the second flip comprising the acts of:

having the players flip another card face side up and on top of the previously flipped card;

determining the winner from the just flipped cards; and having the winner take all of the previously flipped and just flipped cards.

4. The method of playing a card game with a plurality of players using a deck of cards according to claim 1, further comprising the acts of:

conducting a playoff if the act of determining the winner results in a tie between two or more players, the playoff comprising the acts of:

having the two or more players that tied place three cards with the face sides down on top of their previous flipped card;

having the two or more players flip another card face side up and on top of the three cards placed face side down;

determining the winner from the just flipped cards; and having the winner take all of the playoff cards, the tied cards that forced the playoff, and any card that lost in the tie that forced the playoff.

5. The method of playing a card game with a plurality of players using a deck of cards according to claim 1, further including the acts of:

having the players recite "rock, paper, scissors" out loud just before the act of having each player simultaneously flip one card so that the face of the card is up; and having the players recite "go" while simultaneously flipping one card during the act of having each player simultaneously flip one card so that the face of the card is up.

6. The method of playing a card game with a plurality of players using a deck of cards according to claim 1, further including the act of declaring the player that wins all of the cards a winner of the game.

7. A method of playing a card game with a plurality of players using a deck of cards comprising fifty-two cards, wherein the fifty-two cards include three groups of cards, the three groups of the fifty-two cards comprising a plurality of wild cards having a little sister or little brother visual representation thereon, a plurality of scoring cards having a rock, paper, or scissors visual representation thereon, a plurality of non-scoring cards having a broken rock, crumpled paper, or broken scissors visual representation thereon, and wherein all of the three groups of cards have point values thereon indicating a value assigned to each card;

wherein a hierarchy of cards provides that the paper card wins over the rock card, the scissors card wins over the paper card, the rock card wins over the scissors card, the non-scoring cards lose to all other cards, any one of the non-scoring cards does not win over another of the non-scoring cards, the wild cards win over all other cards, and any one of the wild cards does not win over another of the wild cards;

wherein an object of the card game is to be a player with the most points when the game is declared over, said method of playing comprising the acts of:

shuffling all of the cards in the deck with faces down;

evenly distributing the cards with the faces down between the plurality of players;

having each of the plurality of players stack the distributed cards in a stack in front of them;

having each player simultaneously flip one card so that the face of the card is up;

comparing the flipped cards according to the hierarchy of cards;

determining a winner of a hand based on the flipped cards; and having the winner of the hand take all of the flipped cards.

8. The method of playing a card game with a plurality of players using a deck of cards according to claim 7, further comprising the acts of:

conducting a second flip if the act of determining the winner results in no one player winning, the second flip comprising the acts of:

having the players flip another card face side up and on top of the previously flipped card;

determining the winner from the just flipped cards; and having the winner take all of the previously flipped and just flipped cards.

9. The method of playing a card game with a plurality of players using a deck of cards according to claim 7, further comprising the acts of:

conducting a playoff if the act of determining the winner results in a tie between two or more players, the playoff comprising the acts of:

having the two or more players that tied place two cards with the face sides down on top of their previous flipped card;

having the two or more players flip another card face side up and on top of the two cards placed face side down;

determining the winner from the just flipped cards; and having the winner take all of the playoff cards, the tied cards that forced the playoff, and any card that lost in the tie that forced the playoff.

10. The method of playing a card game with a plurality of players using a deck of cards according to claim 7, further comprising the acts of:

conducting a playoff if the act of determining the winner results in a tie between two or more players, the playoff comprising the acts of:

having the two or more players that tied place three cards with the face sides down on top of their previous flipped card;

having the two or more players flip another card face side up and on top of the three cards placed face side down;

determining the winner from the just flipped cards; and having the winner take all of the playoff cards, the tied cards that forced the playoff, and any card that lost in the tie that forced the playoff.

11. The method of playing a card game with a plurality of players using a deck of cards according to claim 7, further including the acts of:

having the players recite "rock, paper, scissors" out loud just before the act of having each player simultaneously flip one card so that the face of the card is up; and having the players recite "go" while simultaneously flipping one card during the act of having each player simultaneously flip one card so that the face of the card is up.

12. The method of playing a card game with a plurality of players using a deck of cards according to claim 7, further including the acts of:

ending the game when a first player is out of cards;

determining each players grant total points for the game by having each player add all of the points in the point values of the cards that they won and subtracting the points in the point values of the cards that they were originally dealt to obtain a grand total score; and declaring the player with the highest grand total a winner of the game.

13. A method of playing a card game with a plurality of players using a deck of cards comprising fifty-two cards, wherein the fifty-two cards include three groups of cards, the three groups of the fifty-two cards comprising a plurality of wild cards having a little sister or little brother visual representation thereon, a plurality of scoring cards having a rock, paper, or scissors visual representation thereon, a plurality of non-scoring cards having a broken rock, crumpled paper, or broken scissors visual representation thereon, and wherein all of the three groups of cards have point values thereon indicating a value assigned to each card;

wherein a hierarchy of cards provides that the paper card wins over the rock card, the scissors card wins over the paper card, the rock card wins over the scissors card, the non-scoring cards lose to all other cards, any one of the non-scoring cards does not win over another of the non-scoring cards, the wild cards win over all other cards, and any one of the wild cards does not win over another of the wild cards;

wherein an object of the card game is to win enough cards having the points in the point values to equal or exceed a points goal, said method of playing comprising the acts of:

having the players set the goal points that will determine a winner;

designating one player as a scorekeeper to calculate each players score based on the points in the point values of the cards they won;

shuffling all of the cards in the deck with faces down;

distributing seven cards with the faces down to each of the plurality of players;

having each of the plurality of players stack the distributed cards in a stack in front of them;

having each player simultaneously flip one card so that the face of the card is up;

comparing the flipped cards according to the hierarchy of cards;

determining a winner of a hand based on the flipped cards; and having the winner of the hand take all of the flipped cards.

14. The method of playing a card game with a plurality of players using a deck of cards according to claim 13, further comprising the acts of:

conducting a second flip if the act of determining the winner of the hand results in no one player winning, the second flip comprising the acts of:

having the players flip another card face side up and on top of the previously flipped card;

determining the winner from the just flipped cards; and having the winner take all of the previously flipped and just flipped cards.

15. The method of playing a card game with a plurality of players using a deck of cards according to claim 13, further comprising the acts of:

conducting a second flip if the act of determining the winner of the hand results in two or more players winning resulting in a tie, the second flip comprising the acts of:

having the two or more tied players flip another card face side up and on top of the previously flipped card;

determining the winner from the just flipped cards; and having the winner take all of the previously flipped and just flipped cards.

16. The method of playing a card game with a plurality of players using a deck of cards according to claim 13, further including the acts of:

having the players recite "rock, paper, scissors" out loud just before the act of having each player simultaneously flip one card so that the face of the card is up; and having the players recite "go" while simultaneously flipping one card during the act of having each player simultaneously flip one card so that the face of the card is up.

17. The method of playing a card game with a plurality of players using a deck of cards according to claim 13, further including the acts of:

ending the hand when a last player is out of cards;

determining each players grant total points for the game by having each player add all of the points in the point values of the cards that they won; and having the scorekeeper record each players score.

18. The method of playing a card game with a plurality of players using a deck of cards according to claim 13, further including the acts of:

distributing an additional seven cards with the faces down to each of the plurality of players if none of the players reach the points goal;

having each of the plurality of players stack the distributed cards in a stack in front of them;

having each player simultaneously flip one card so that the face of the card is up;

comparing the flipped cards according to the hierarchy of cards;

determining a winner of a hand based on the flipped cards; and having the winner of the hand take all of the flipped cards.

19. The method of playing a card game with a plurality of players using a deck of cards according to claim 13, further including the acts of:

ending the game when a first player has enough points to equal or exceeds the points goal; and declaring the first player a winner of the game.

20. A method of playing a card game with a plurality of players using a deck of cards comprising a plurality of cards, providing a deck of cards comprising a plurality of cards, each one of said plurality of cards having at least one indicia thereon selected from a plurality of indicia, wherein a quantity of cards which comprises the plurality of cards is evenly divisible by a number that represents a number of different plurality of indicia on the plurality of cards without taking into account wild cards, said deck of cards including three groups of cards based on the indicia, the three groups of the plurality of cards comprising a plurality of wild cards having indicia of a little sister or little brother visual representation thereon, a plurality of scoring cards having indicia of a rock, paper, or scissors visual representation thereon, a plurality of non-scoring cards having indicia of a broken rock, crumpled paper, or broken scissors visual representation thereon, and wherein all of the three groups of cards have point values thereon indicating a value assigned to each card;

wherein a hierarchy of cards provides that the paper card wins over the rock card, the scissors card wins over the paper card, the rock card wins over the scissors card, the non-scoring cards lose to all other cards, any one of the non-scoring cards does not win over another of the non-scoring cards, the wild cards win over all other cards, and any one of the wild cards does not win over another of the wild cards;

wherein an object of the card game is to be a player that wins all of the cards in the deck, said method of playing comprising the acts of:

shuffling all of the cards in the deck with faces down;

evenly distributing the cards with the faces down between the plurality of players;

having each of the plurality of players stack the distributed cards in a stack in front of them;

having each player simultaneously flip one card so that the face of the card is up;

comparing the flipped cards according to the hierarchy of cards;

determining a winner based on the flipped cards; and having the winner take all of the flipped cards.

* * * * *